US008235484B2

(12) United States Patent
Ray et al.

(10) Patent No.: US 8,235,484 B2
(45) Date of Patent: Aug. 7, 2012

(54) PRINTBAR SUPPORT MECHANISM

(76) Inventors: Paul C. Ray, San Diego, CA (US); Thomas J. Tarnacki, San Diego, CA (US)

( * ) Notice: Subject to any disclaimer, the term of this patent is extended or adjusted under 35 U.S.C. 154(b) by 960 days.

(21) Appl. No.: 12/253,270

(22) Filed: Oct. 17, 2008

(65) Prior Publication Data

US 2009/0295866 A1 Dec. 3, 2009

Related U.S. Application Data

(60) Provisional application No. 61/056,792, filed on May 28, 2008.

(51) Int. Cl.

| | |
|---|---|
| ***B41J 25/308*** | (2006.01) |
| ***B41J 29/38*** | (2006.01) |
| ***B41J 2/15*** | (2006.01) |
| ***B41J 2/155*** | (2006.01) |

(52) U.S. Cl. ..... 347/8; 347/13; 347/40; 347/42

(58) Field of Classification Search ..... 347/8, 13, 347/40, 42, 49, 102, 104

See application file for complete search history.

(56) References Cited

U.S. PATENT DOCUMENTS

| | | | | |
|---|---|---|---|---|
| 4,390,292 | A | 6/1983 | Krenz | |
| 4,949,098 | A * | 8/1990 | Gluck et al. | 347/197 |
| 5,227,809 | A | 7/1993 | Carpenter et al. | |
| 5,592,202 | A | 1/1997 | Erickson | |
| 6,565,182 | B1 * | 5/2003 | Fredrickson et al. | 347/20 |
| 6,592,200 | B2 | 7/2003 | Wotton et al. | |
| 7,181,944 | B2 | 2/2007 | Wuestefeld et al. | |
| 7,350,893 | B2 | 4/2008 | Teshigawara et al. | |
| 2002/0007740 | A1 * | 1/2002 | Cutcher | 101/123 |
| 2003/0081053 | A1 * | 5/2003 | Barinaga et al. | 347/32 |
| 2005/0024421 | A1 * | 2/2005 | Barinaga et al. | 347/22 |
| 2005/0035990 | A1 * | 2/2005 | Wotton et al. | 347/22 |

* cited by examiner

*Primary Examiner* — Charlie Peng
*Assistant Examiner* — Hung Lam

(57) ABSTRACT

A web press printer includes a printbar supporting an array of printheads extending across a media web. The printbar includes a support member coupled to the printbar via one or more biasing mechanisms to locally counteract a deflection of the printbar at a location of one or more of the respective printheads along the printbar.

16 Claims, 6 Drawing Sheets

PRINTBAR SUPPORT MECHANISM

This application claims the benefit of provisional patent application Ser. No. 61/056,792, filed May 28, 2008, titled "PRINTBAR SUPPORT MECHANISM."

BACKGROUND

Fluid ejection technology has been applied to a variety of different types of printers, including the web press. Like most printers, to achieve quality in a web press, a distance between a printhead and the media should be tightly controlled. In many instances, it has proven challenging to maintain this proper distance. For example, this distance can be compromised in conventional web presses when maintenance operations are performed on the fluid ejection devices, thereby leading to a time-consuming realignment of the fluid ejection devices. In other instances, the sheer size and/or complexity of the various frames used to support the media or the printheads can complicate maintaining the proper distance between the printheads and the media.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Embodiments of the present disclosure are generally directed to a printbar of a web press. In one embodiment, the printbar supports an array of printheads extending over a media and includes a support mechanism to maintain correct spacing between each individual printhead and the media.

The support mechanism extends along a length of the printbar and is configured to exert a biasing force to one or more locations adjacent the respective printheads. The biasing force counteracts deflections of the printbar to maintain a correct spacing between the media and each respective printhead. In one aspect, the support mechanism includes an elongate rigid member and a biasing mechanism to exert the biasing force at select locations. In one embodiment, the biasing mechanism includes fastening mechanisms configured to couple the elongate rigid member to the printbar. In one aspect, the biasing mechanism balances deflections of the printbar by increasing some deflections of the printbar (such as those near the outer ends of the printbar) while decreasing other deflections of the printbar (such as those near the middle portions of the printbar) to achieve an overall uniform spacing between the media and the array of printheads.

Figure 1:
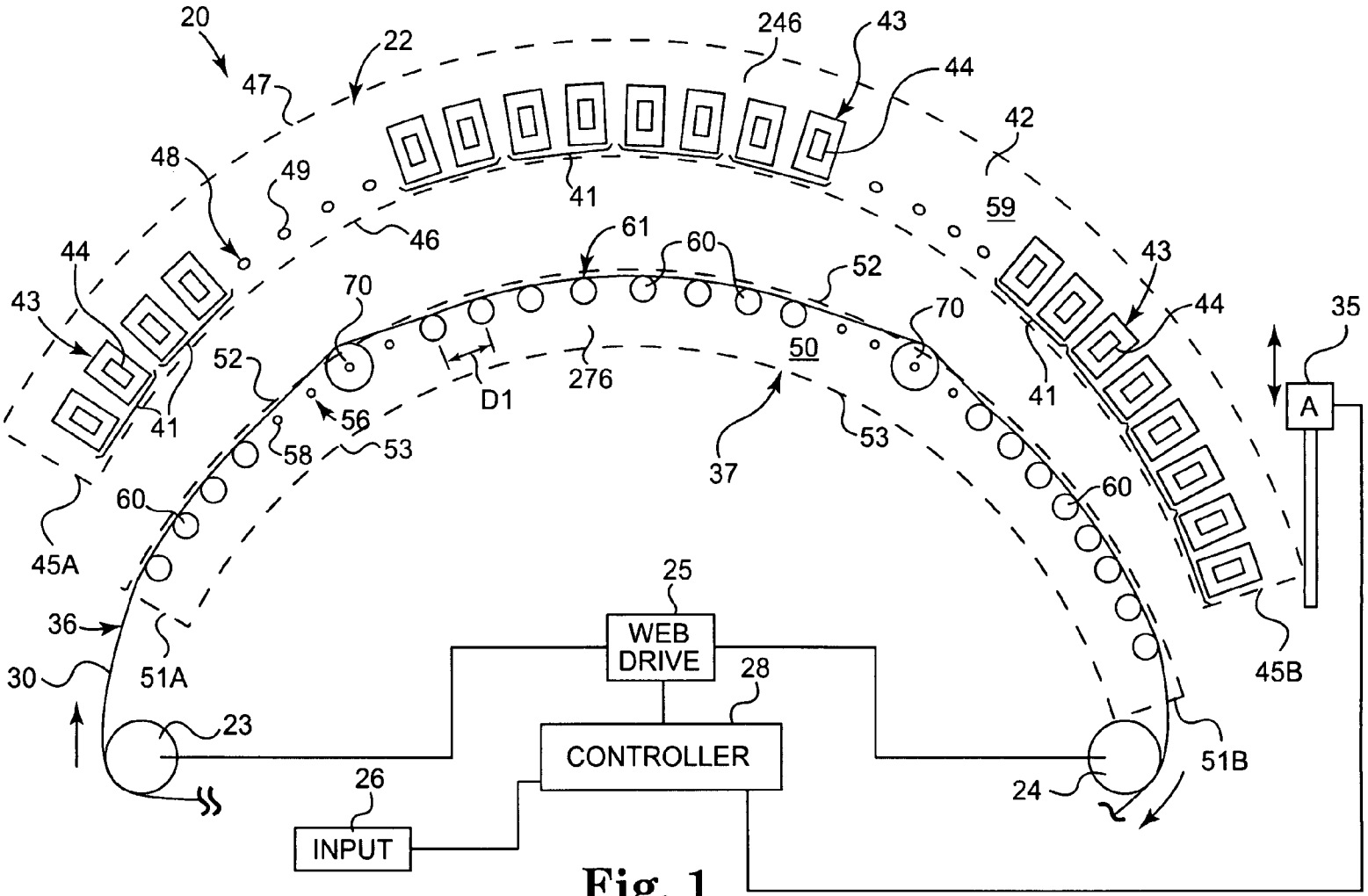
FIG. 1 is schematic illustration of a printing system including a printing module in a raised maintenance position, according to an embodiment of the present disclosure.

FIG. 1 is a schematic illustration of a printing system 20 according to an example embodiment. Printing system 20 is configured to print or otherwise deposit printing material, such as ink or other fluid material, onto a web 30 of media. As will be described hereafter, printing system 20 includes an arch support structure and printbar support mechanism which facilitate proper alignment and spacing of printing elements relative to a media.

Printing system 20 includes a print module 22 and media support 37. Print module 22 selectively deposits printing material upon web 30 to form an image, pattern, layout or arrangement of printing material upon web 30. In one embodiment, web 30 may comprise a web of printing material such as a cellulose-based media. In another embodiment, web 30 may comprise a web of polymeric material. In yet another embodiment, web 30 may comprise one or more other materials. In one embodiment, the printing material comprises a fluid such as one or more inks. In yet other embodiments, the printing material may comprise other types of fluid.

Media support 37 of printing system 20 receives the web 30 of media from a web supply 23, and after printing module 22 prints upon web 30, media support 37 discharges the printed upon web 30 to media rewind 24 which rewinds the web 30 of media. Each of web supply 23 and media rewind 24 comprises one or more rollers which are controlled by web drive 25 and therefore each of web supply 23 and media rewind 24 act as control rollers. Although web 30 is illustrated as continuously extending from supply 23, across print module 22 and media support 37, to rewind 24, in other embodiments, media rewind 24 may be omitted where the printed upon web 30 of media is severed or processed in other fashions.

In one embodiment, print module 22 includes main support 42, printbars 41, and one or more pens or cartridges 43 that each include printheads 44. As shown in FIG. 1, main support 42 comprises an arc shaped frame and is represented in dashed lines for illustrative purposes to better represent the arc configuration of cartridges 43 and printbars 41 (as supported by main support 42) which would otherwise be obscured by main support 42 in FIG. 1. In one embodiment, main support 42 includes a bottom portion 46, a top portion 47, a first end 45A, and a second end 45B.

Main support 42 of printing module 22 comprises an arcuate frame 59 or structure configured to support individual print printbars 41 (and their cartridges 43) in an arc configuration opposite to web 30. Moreover, printbars 41 extend across a width of media support 37 to support the one or more print cartridges 43. Printbars 41 facilitate removal of cartridges 43 from main support 42 for repair or replacement of individual print cartridges 43 without removal of all of the print cartridges 43 from main support 42. Printbars 41 are later described in more detail in association with FIGS. 2-8.

In one embodiment, actuator 35 is configured to move main support 42 towards and away from web 30. In yet another embodiment, printing system 20 omits the actuator 35 so that main support 42 is stationary opposite to web 30. When present, actuator 35 comprises a mechanism configured to selectively raise and lower main support 42 to raise and lower printbars 41 (and their cartridges 43) relative to web flow path 36 and web 30. In one aspect, because each printbar 41 is releasably secured relative to main support 42, movement of main support 42 results in moving the printbars 41 (and their cartridges 43) in unison. Accordingly, via actuator 35, main support 42 may be moved to facilitate enhanced access to cartridges 43 for inspection, servicing, repair, or replacement.

In one embodiment, actuator 35 comprises one or more hydraulic or pneumatic cylinder assemblies. In another embodiment, actuator 35 comprises one or more electric solenoids. In yet another embodiment, actuator 35 may comprise one or more cams driven by one or more motors. In other embodiments, ball screw mechanisms are used. In such embodiments, movement of support 42 by actuator 35 may be guided by one or more guide rods, tracks or other guide structures. In still other embodiments, the one or more guides may be omitted.

While FIG. 1 illustrates print module 22 of printing system 20 in a raised position relative to media support 37 (to permit servicing or maintenance), it is understood that print module 22 can be lowered into a printing position relative to media support 37. Accordingly, it is further understood that controller 28 generates control signals directing actuator 35 to lower main support 42 which lowers individual printbars 41 (and their associated cartridges 43) from a maintenance position (shown in FIG. 1) to a lowered printing position 2 in which print heads 44 are closely spaced to web 30 (as supported by media support 37).

Figure 3:
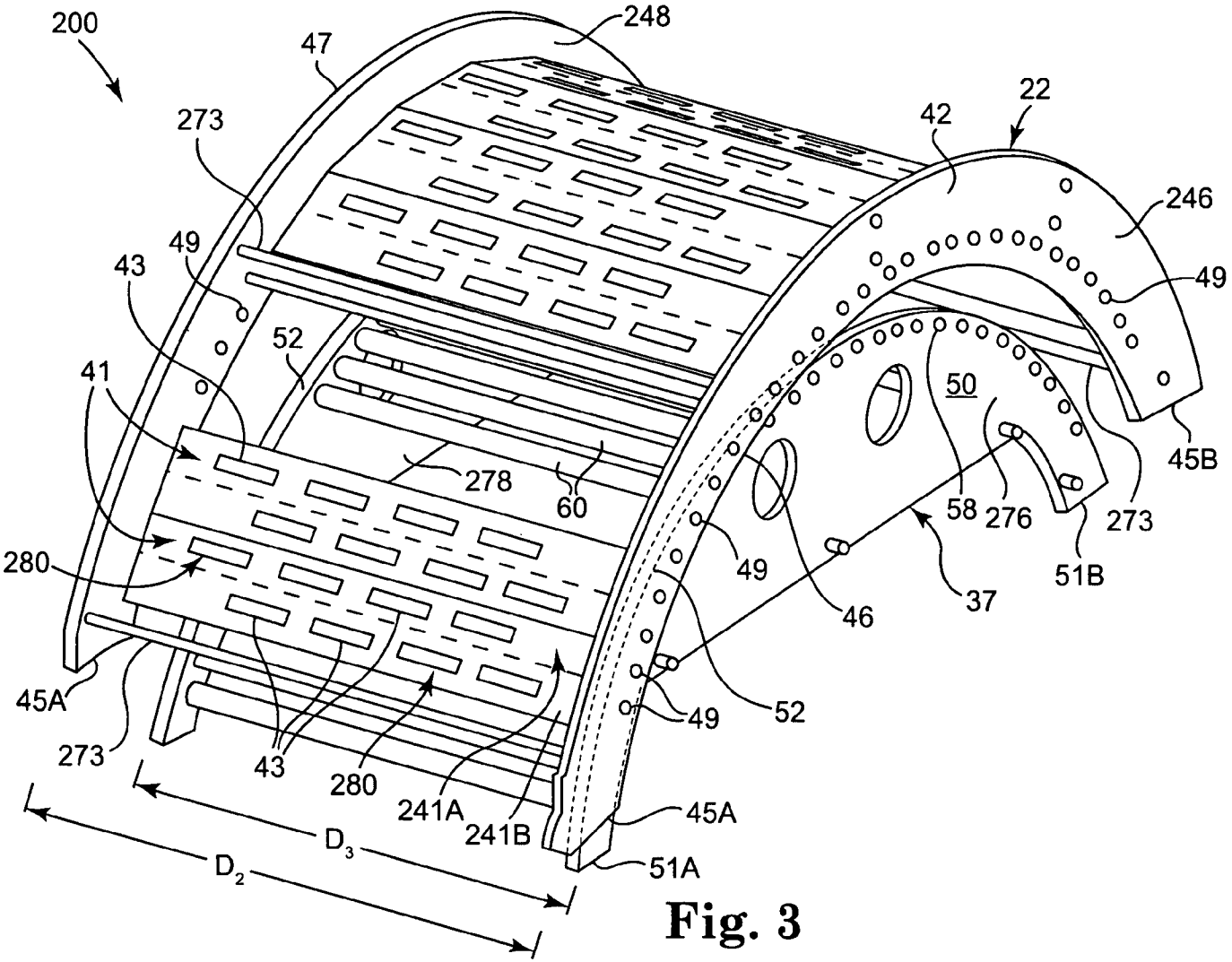
FIG. 3 is perspective view of a printing system including a media support and a first arcuate frame supporting an array of printbars, according to an embodiment of the present disclosure.

In one aspect, in the lowered printing position each print head 44 of printing module 22 is spaced from web 30 by a gap G as further schematically illustrated in FIG. 3. For example, in one embodiment, in the printing mode a gap G between printheads 44 of cartridges 43 and web 30 is less than or equal to about 1 mm. In other embodiments, this gap may have other dimensions. In one aspect, the substantially the same gap G is maintained uniformly across a width of media web 30 via a support mechanism of printbar 41 that supports the row of printheads 44 or cartridges 43, as further described herein.

As shown in FIG. 3, print head 44 includes nozzles 102 while portion 130 of media web 30 extends over a contact region 110 of a roller 60 of media support 37. In this embodiment, gap G represents the distance between just one print head 44 of a printbar and media web 30 (as supported on a roller 60). Accordingly, when media support 37 a series of rollers 60, the printhead-to-media spacing is maintained from printbar to printbar in the direction of travel of media web 30 via arcuate frame 59 to correctly position each printbar (supporting a row of printheads transverse to media web 30) over a different roller 60. However, it is understood that media support 37 can comprise other flat structures (e.g., a plate, platen, etc.) instead of a series of rollers 60, such that there is a constant spacing in the direction of media travel between each printbar and the media. On the other hand, as further described in association with FIGS. 4-8, embodiments of the present disclosure provide a support mechanism to maintain a correct spacing between the media and each printhead of a printbar in a direction transverse to the direction of travel of the media.

Referring again to FIG. 1, media support 37 is in a fixed position while main support 42 moves towards media support 37 for positioning in the printing mode and main support 42 moves away from media support 37 for positioning in the service mode. However, in another embodiment, main support 42 is in a fixed position while media support 37 moves towards main support 42 for positioning in the printing mode and media support 37 moves away from main support 42 for positioning in the service mode.

After movement of the print module 22 into the printing position is completed, controller 28 generates additional control signals directing cartridges 43 and print heads 44 to deposit a printing material upon web 30.

Referring again to FIG. 1, cartridges 43 (also known as pens) comprise mechanisms configured to eject fluid onto web 30. In the particular example illustrated, cartridges 43 each include one or more print heads 44 (schematically shown as part of cartridges 43). In one embodiment, print heads 44 each comprise thermal resistive drop-on-demand inkjet print heads. In yet other embodiments, print heads 44 may comprise piezo-resistive inkjet print heads. In still other embodiments, print heads 44 may comprise other mechanisms configured to eject fluid in a controlled manner.

According to one embodiment, cartridges 43 each include a self-contained reservoir of fluid which is applied to the associated print heads 44. In yet another embodiment, cartridges 43 each include a reservoir which is further supplied with fluid or ink via an off-axis ink supply system using one or more pumps or other mechanisms to supply a fluid to each of cartridges 43. In one embodiment, cartridges 43 of print module 22 are configured to apply multiple colors of ink. In the embodiment illustrated, cartridges 43 configured to deposit black (K), cyan (C), magenta (M) and yellow (Y) colored inks. In the example illustrated, print module 22 is additionally configured to apply a fixer (F) to web 30 prior to application of the colored inks. In other embodiments, print module 22 may include a fewer or greater of such cartridges 43 configured to apply a fewer or greater of such different types of fluid.

Media support 37 comprises one or more structures configured to support and guide movement of web 30 in a path by and opposite to print heads 44 of cartridges 43. In the particular embodiment illustrated, media support 37 supports web 30 in an arc opposite to print heads 44. This arc configuration, in turn, permits the frame 50 of print module 22 to be formed in a more compact configuration, thereby enhancing control over the spacing between print heads 44 and media web 30. In one embodiment, the arc-shaped configuration of media support 37 comprises an arcuate frame 50 supporting a series 61 of rollers 60 in an arcuate pattern. In one embodiment, arcuate frame 50 of media support 37 comprises a top portion 52, bottom portion 53, and side portions 51A, 51B.

In one aspect, the arcuate pattern of rollers 60 is shaped and sized so that when main support 42 is lowered into its print position, the arc configuration of the cartridges 43 (as supported by frame 59 of main support 42) substantially matches the arcuate pattern of rollers 60 so that a substantially uniform gap is provided between the printheads 44 (of cartridges 43) and media web 30 along the length of media web 30 extending underneath cartridges 43 of print module 22.

In another embodiment, media support 37 may comprise an arcuate plate or platen. In other embodiments, media support 37 may have other configurations.

Web flow path 36 comprises a path formed by one or more stationary or movable structures along which web 30 is guided and moved. In the particular example illustrated, web flow path 36 is formed by the arcuately arranged rollers 60 forming media support 37, and as well as other control rollers that act in support of media rewind 24 and 23.

Media supply 23 and media rewind 24 comprise independently rotationally driven rollers which further define or form web flow path 36 and which move media web 30 along web flow path 36. Media supply 23 is located immediately upstream of cartridges 43 and their associated print heads 44. Media rewind 24 is located immediately downstream of cartridges 43 and their associated print heads 44 along web flow path 36. A general printing zone is defined between media supply 23 and media rewind 24 as web 30 extends across rollers 60. The rollers comprising media supply 23 and media rewind 24 are configured to be driven at different speeds, facilitating adjustment of the tension of web 30 across and opposite to cartridges 43 during printing upon web 30. At the same time, media supply 23 and media rewind 24 may be driven at substantially the same speed, facilitating precise velocity control of web 30 across the printing zone formed by media supply 23, media rewind 24, and rollers 60. In one aspect, web drive 25 comprises one or more mechanisms configured to rotationally drive rollers 23, 24, which in turn, selectively supplies distinct levels of torque or velocity to rollers 23, 24 using one or more transmissions and clutch mechanisms.

Input 26 comprises one or more mechanisms by which instructions or commands may be provided to controller 28. Examples of input 26, include, but are not limited to, a keyboard, a keypad, a touchpad, a touch screen, a microphone with speech recognition software, one or more buttons, switches and the like. Although input 26 is illustrated as being associated with print module 22, input 26 may be an external source of commands which transmits control signals via the internet, a network or other wired or wireless communication medium.

Controller 28 comprises one or more processing units and associated memories configured to generate control signals directing the operation of print module 22. In particular, in response to or based upon commands received via input 26 or instructions contained in the memory of controller 28, controller 28 generates control signals directing operation of actuator 35 to selectively raise and lower support 42 and cartridges 43, control signals directing the application or deposition of printing material by cartridges 43 and print heads 44, and control signals directing supply 23 and/or rewind 24 to control the tension of web 30 and directing the rate at which web 30 is moved across media support 37.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor limited to any particular source for the instructions executed by the processing unit.

Referring again to FIG. 1, in another aspect media support 37 comprises a first arcuate frame 50 and a second arcuate frame 59 forms main support 42 of print module 22. While the first arcuate frame 50 comprises a pair of spaced apart arcuate plates 276, 278 (as shown more fully in FIG. 3) with rollers 60 extending and supported therebetween, just one plate 276 is illustrated in FIG. 1. Likewise, while the second arcuate frame 59 comprises a pair of spaced apart arcuate plates 246, 248 (as shown in FIG. 3) with the printbars 41 (and associated cartridges 43) extending and supported therebetween, just one of the respective plates 246 is illustrated in FIG. 1.

Referring again to FIG. 1, in one embodiment, first arcuate frame 50 of media support 37 also includes an arc-shaped array 56 of holes 58 extending along the arc-shaped top portion 52. In one aspect, each hole 58 is configured to releasably secure each roller 60 in position along the arc and thereby enables selective positioning of the respective rollers 60 along the arc-shaped top portion 52 of media support 37 to provide proper support to media web 30.

Although rollers 60 are depicted in FIG. 1 as being below top portion 52 (i.e., not extending above top portion 52) for illustrative clarity to identify the rollers 60 separately from web 30 and separately from top portion 52, it is understood that the rollers 60 are normally positioned at or near an edge of top portion 52 of media support 37 so that a top portion of the rotatable rollers 60 are in close proximity to a printhead 44 (or row of printheads 44) of print module 22.

Figure 2:
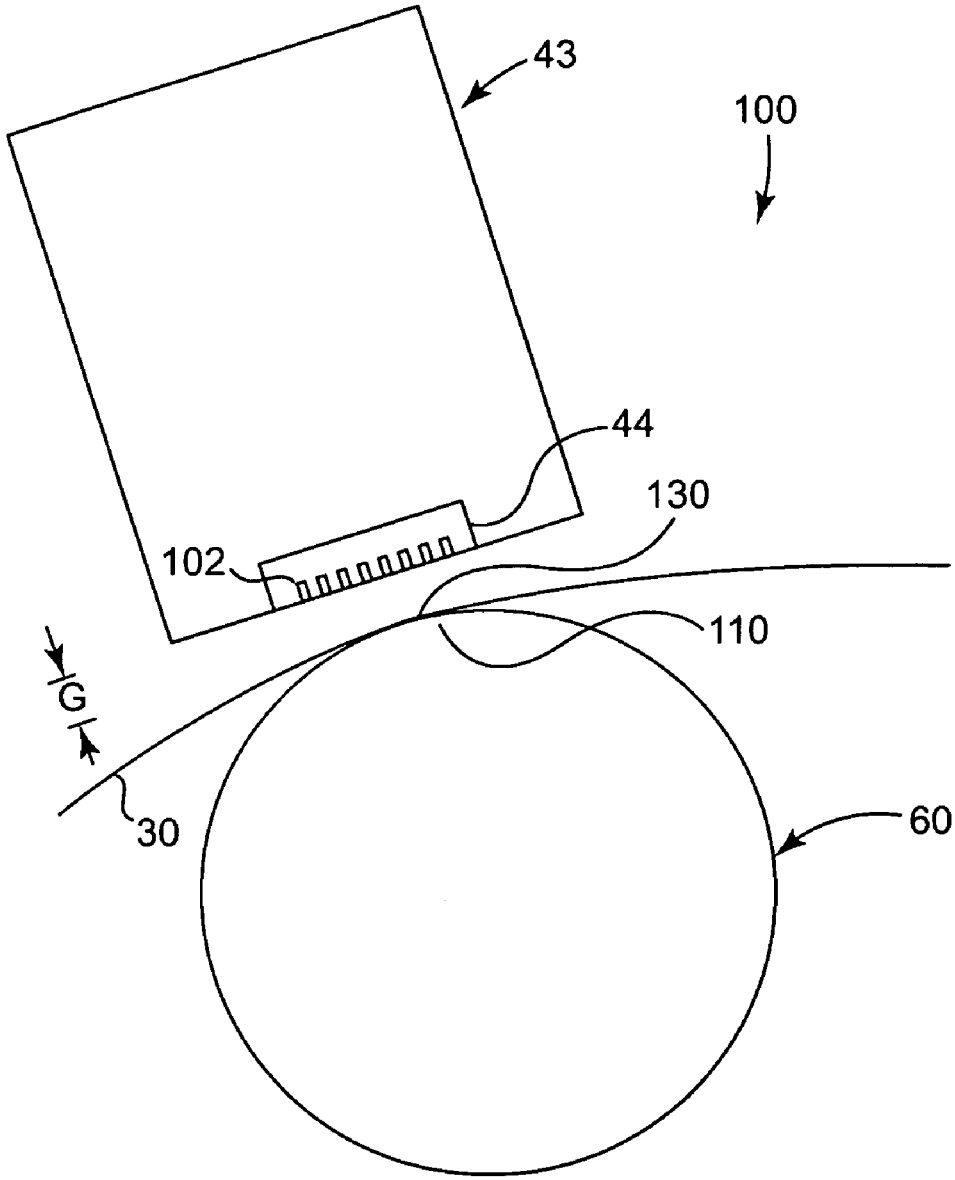
FIG. 2 is schematic illustration of a printing element and a media support of a printing system, according to an embodiment of the present disclosure.

It is further understood that media support 37 is not limited to the configuration shown in FIGS. 1-3, but in other embodiments media support 37 comprises any one of several different types of configurations known to those skilled in the art to convey media M in a travel path underneath printhead 44.

In another aspect, second arcuate frame 59 comprises an arc-shaped array 48 of holes 49 extending along arc-shaped bottom portion 46 of frame 59 of print module 22. Holes 49 are configured to releasably secure printbars 41 in selected positions along the arc-shaped bottom portion 46 to form a pattern of printbars 41 (and their cartridges 43) that substantially match a pattern of rollers 60 mounted in first arcuate frame 50 of media support, as previously described.

In one embodiment, holes 49 are spaced apart uniformly while in other embodiments, holes 49 are spaced apart non-uniformly.

In one embodiment, as shown in FIGS. 1 and 3, each printbar 41 supports two rows 280 of cartridges 43. In this embodiment, each printbar 41 is supported by a pair of adjacent holes 49 in each one of the respective spaced apart plates 246. 248 of second arcuate frame 59, as further illustrated in FIG. 3. However, in other embodiments, each printbar 41 supports just one row of cartridges 43 and each printbar 41 is supported by a single hole 49 in each one of the respective spaced apart plates 246, 248 of second arcuate frame 59 of print module 22, as later described in more detail in association with FIG. 3.

FIG. 3 is a perspective view of a printing system 200, according to one embodiment of the present disclosure. In one aspect, printing system 200 includes substantially the same features and attributes as printing system 20 as previously described and illustrated in FIGS. 1-2 with like reference numerals generally referring to like elements. In one embodiment, as shown in FIG. 3, printing system 200 comprises a printing module 22 and a media support 37. The printing module 22 includes main support 42 that supports an array of printbars 41, which are represented schematically. Each printbar 41 extends between two spaced apart, arch-shaped plates 246, 248 and supports one or more rows 280 of cartridges 43. Together, the printbars 41 extend in an arc configuration along the web flow path 36 as established by the arc-shaped plates 246, 248 of main support 42.

In one embodiment, each printbar 41 supports two rows 280 of cartridges 43 and each printbar 41 is supported via two holes 49 of array within plates 246, 248 of main support 42. As understood by one skilled in the art, a variety of fasteners (such as pins) cooperable with holes 49 extending from the ends at the printbars 41 and are used to secure the printbars 41 relative to plates 246, 248. Accordingly, in this arrangement, with the positioning of a single printbar 41 along the arc of plates 246, 248, the rows 280 of cartridges 43 are positioned in an arc configuration a pair at a time.

However, in another embodiment, each printbar 41 is divided into two separate portions with each separate portion 241A, 241B supporting a single row of cartridges 43. In this arrangement, each printbar 41 would be supported via a single hole 49 on each plate 246, 248 of main support 42. Accordingly, in this arrangement, each row of cartridges 43 is positioned or re-positioned one at a time instead of a pair at a time (as in the former embodiment).

In one embodiment, print module 22 also comprises cross supports 273 that extend between, and are supported by, plates 246, 248. However, at the same time, cross supports 273 maintain proper spacing between the respective plates 246, 248 and provide stability to the arcuate frame 59 forming main support 42. This stability is of particular interest when the printbars 41 (with rows of cartridges 43 thereon) are sometimes removed, interchanged, or omitted in some locations along the arcuate frame 59 of main support 42. In these instances, the cross supports 273 maintain the plates 246, 248 in their fixed, spaced apart positions relative to each other. While not shown in FIG. 3 for illustrative clarity, additional cross supports 273 also extend between and support plates 276, 278 of arcuate frame 50 of media support 37 in a manner substantially similar to the support to main support 42.

In another aspect, FIG. 3 illustrates that a distance (D2) of separation between plates 246, 248 of arcuate frame 59 forming main support 42 is greater than a distance (D3) of separation between plates 276, 278 of arcuate frame 50 forming media support 37. In other words, the frame 50 of media support 37 is narrower than frame 59 of print module 22 (along an orientation perpendicular to the web flow path 36) so that the media support 37 effectively nests within the main support 42 of the printing module 22 when the printing module 22 is moved to a lowered printing position. This nesting arrangement causes the printheads 44 of print cartridges 43 to be positioned in close proximity (see, for example, FIG. 2) relative to media web 30 and media support 37.

Figure 4:
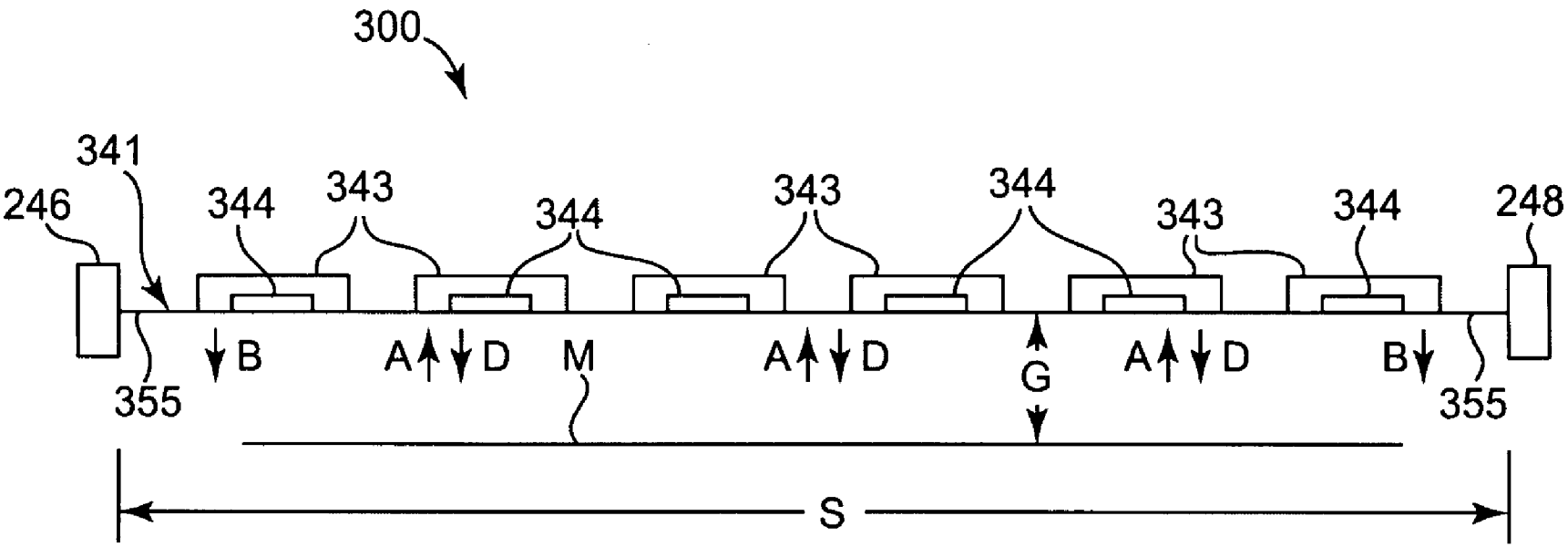
FIG. 4 is a schematic illustration of the action of a support mechanism to counteract deflections of a printbar, according to an embodiment of the present disclosure.

FIG. 4 is a schematic illustration of a printing system 300 including a printbar 341, according to one embodiment of the present disclosure. In one embodiment, printing system 300 includes at least substantially the same features and attributes of the printing system 20, 200 previously described in association with FIGS. 1-3.

As shown in FIG. 4, printbar 341 is supported exclusively, via its ends 355, by frames 246 and 248 (also shown in FIG. 3) to extend across an entire width of media M. Accordingly, printbar 341 supports an array of print cartridges 343 (including associated printheads 344) to extend in a spaced relationship above media M. In some embodiments, printbar 341 can have a length spanning (represented by S) as long as 4 feet across the media M. In order to maintain current spacing between each individual printhead 344 and media M along the entire length of printbar 341, a support mechanism (shown in detail in FIGS. 5-8) provides a biasing force at one or more points (indicated by directional arrows A) to counteract one or more deflection points of the printbar 341 (as indicated by directional arrows D). In particular, because the relatively long span of printbar 341 is supported primarily or exclusively at its ends 355, the middle portion or intermediate portions of the printbar 341 can experience small deflections (as indicated by directional arrow D) due to the loading of the printbar 341 with printhead cartridges 343 and associated components. These deflections alter a desired spacing between each printhead 344 and media M. However, the support mechanism provided according to principles of the present disclosure provides a selectively applied via biasing action that counteracts these deflection points, thereby maintaining the proper spacing between each individual printhead 344 and media M, particularly in the middle or intermediate portions of the printbar 341.

In another embodiment, in addition to one or more upward biasing actions (as represented by directional arrows A) applied along printbar 341, one or more downward biasing actions (as represented by directional arrows B) also can be selectively applied to printbar 341. In one aspect, the combination of the selective upward biasing actions and the selective downward biasing actions act together to minimize the overall variation in deflections along the length of printbar 341. In particular, in most instances where a greater downward deflection occurs in the middle portion of the printbar and a lesser deflection occurs at outer portions of the printbar 341, a more uniform average deflections along printbar 341 is achieved via applying selective upward biasing actions at the middle portions of printbar 341 and applying selective downward biasing actions at the outer portions of printbar 341. As further described in association with FIG. 5, the biasing mechanism is adjustable to apply the desired degree or amount of biasing force to achieve the desired counter-deflection on printbar 341.

Figure 5:
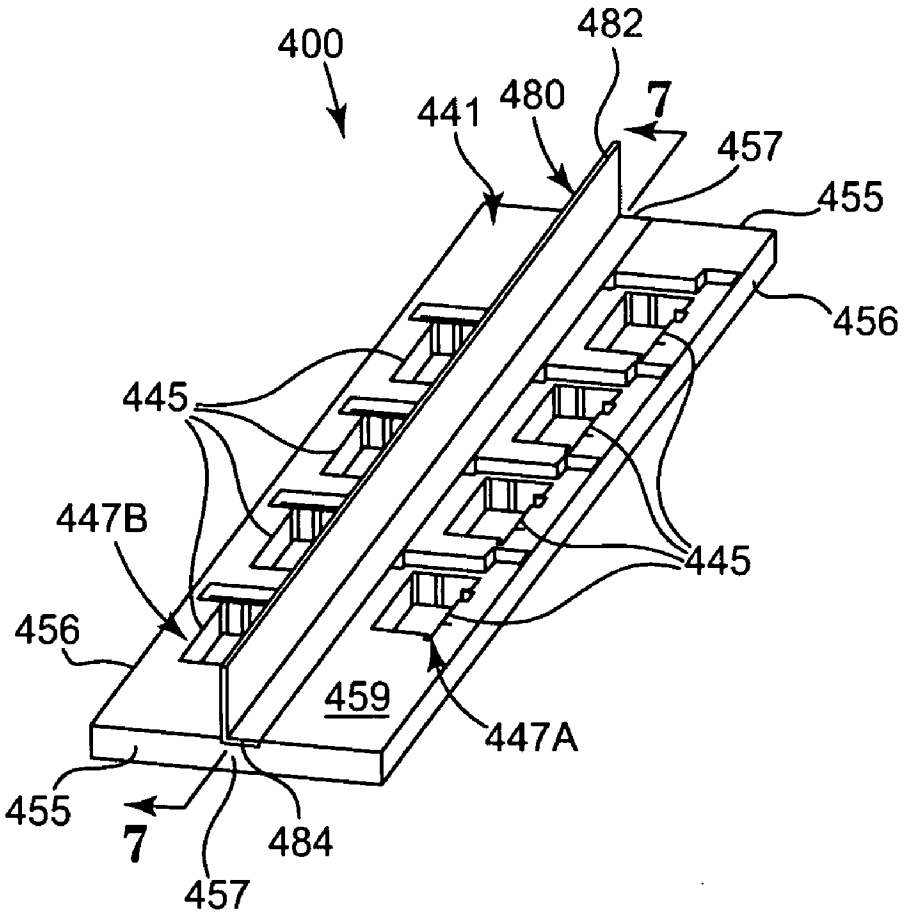
FIG. 5 is a perspective view of a printbar including a support member, according to an embodiment of the present disclosure.

FIG. 5 is a perspective view of a printbar assembly 400 including a printbar 441 and a support member 480, according to an embodiment of the present disclosure. In one embodiment, in all other respects printbar 41 includes at least substantially the same features and attributes as printbar 41 and 341 as previously described in Association with FIGS. 1-4.

As shown in FIG. 5, printbar 441 includes a pair of opposite ends 455 and a pair of opposite side edges 456. In one aspect, printbar 441 also includes a center region 457 which extends between the respective ends 455. In another aspect, printbar 441 includes two rows 447A, 447B of cartridge slots 445 adapted to hold printhead cartridges 443, similar to cartridges 43 shown in FIG. 1. In some embodiments, printbar 441 may include just one row (either 447A or 447B) of cartridge slots 445. Nevertheless, in the embodiment shown in FIG. 5, one row 447A of cartridge slots 445 extends along a side edge 456 while the other row 447B of cartridge slots 445 extends along the opposite side edge 456. In addition, in one aspect, the cartridge slots 445 (and therefore the cartridges 443) of the first row 447A are staggered with respect to the cartridge slots 445 of the second row 447B to ensure complete coverage of the printheads across the media web 30. In another aspect, center portion 457 of printbar 441 extends along a length of printbar 441 to bisect first row 447A relative to second row 447B.

As further shown in FIG. 5, support member 480 provides a support mechanism for printbar 441 to precisely maintain a correct spacing between each respective printhead (of cartridges 443) and the media M (or media web 30 in FIG. 1-3). Into one embodiment, support member 480 comprises an elongate generally rigid member having a length substantially the same as a length of the printbar 441. In one embodiment, support member 480 additionally forms a cross-sectional L-shaped configuration, which is also further illustrated in FIGS. 7-8. The generally L-shaped support member 480 includes a base portion 484 and a vertical portion 482 with the base portion 484 configured for mounting onto center portion 457 of printbar 441. Vertical portion 482 extends vertically upward from a surface 459 of printbar 441 to provide an additional rigidity along the length of printbar 441, which in turn thereby helps to maintain correct spacing between each printhead 444 and the media M.

Figure 6:
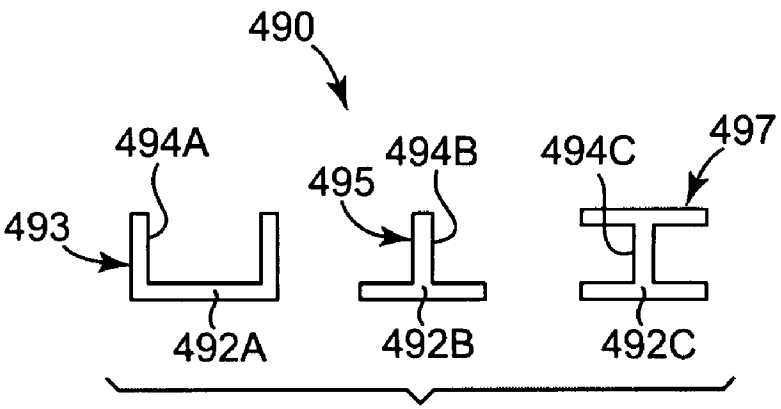
FIG. 6 is a schematic illustration of a group of other support members, according to an embodiment of the present disclosure.

FIG. 6 is a schematic illustration of a group 490 of alternate support members of a support mechanism for a printbar, according to an embodiment of the present disclosure. In one embodiment, in all other respects, the support members 493, 495, and 497 comprise at least substantially the same features and attributes as support member 480 of FIG. 5, except having a different cross-sectional shape. Accordingly, as shown in FIG. 6, support member 493 comprises a U-shaped or channel including a base portion 492A and a vertical portion 494A with the vertical portion 494A arranged as a pair of spaced apart sidewalls extending vertically upward from the base portion 492A. In another configuration, support member 495 comprises a T-shaped member including a base portion 492B and a vertical portion 494B. In this arrangement, the base portion 492B extends outwardly on opposite sides from vertical portion 494B with vertical portion 494B extending vertically upward from a generally center region of the base portion 492B. In yet another configuration, a support member 497 comprises an I-shaped member including a base portion 492C in a vertical portion 494C that completes the I-shape. As in the embodiment of FIG. 5 in which support member 480 comprises an L-shaped member, the base portion (e.g., base portion 492A, 492B, 492C) of each of the differently shaped support members (e.g., support member 493, 495, 497, respectively) is sized and shaped to enable coupling of the base portion relative to printbar 441 via a fastening mechanism, such as fastening mechanism 470 (FIG. 4).

Figure 7:
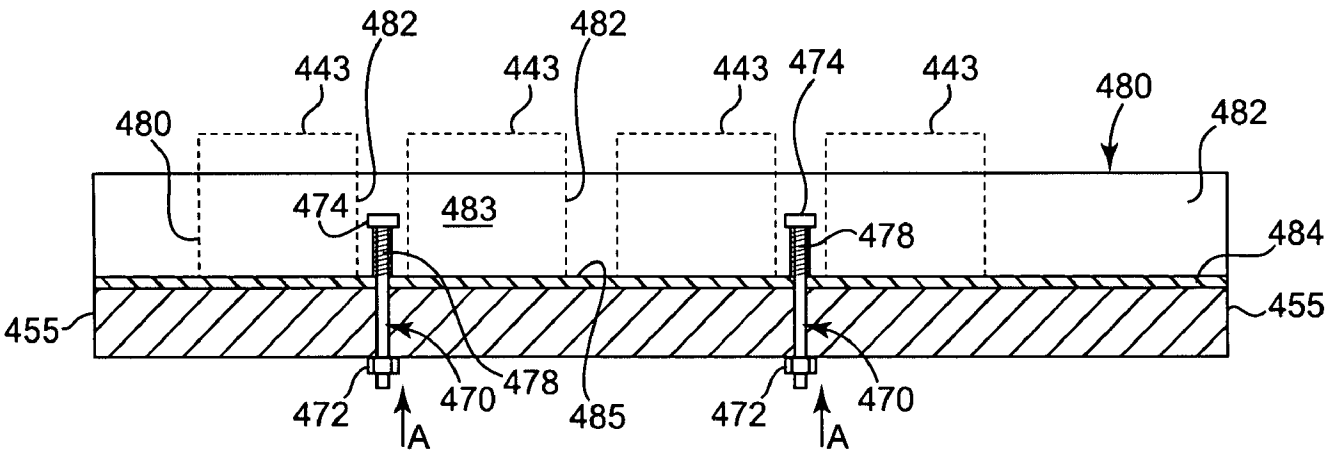
FIG. 7 is a sectional view as taken along lines 7-7 of FIG. 5, according to an embodiment of the present disclosure.

FIG. 7 is a sectional view of printbar 441 and support member 480 of the FIG. 5, according to one embodiment of the present disclosure. As further illustrated in FIG. 7, in another aspect, in addition to the L-shaped support member 480, the support mechanism of printbar 441 further includes at least one fastening mechanism 470 configured to couple the support member 480 to the printbar 441. In one embodiment, the fastening mechanism 470 includes a bolt, rod, or other coupling structure in combination with a biasing mechanism (e.g., spring 478) arranged to draw base portion 484 of support member 480 against to surface 459 of printbar 441. As previously described in connection with FIG. 4, the biasing action provided by the biasing mechanism is arranged to counteract one or more deflections of printbar 441. Accordingly, the fastening mechanism(s) 470 are located strategically along the length of the printbar 441 to provide such a biasing action in a location corresponding to the deflection to be prevented.

In another aspect, in order to achieve an overall uniform media-to-printhead spacing, it is also understood that fastening mechanism 470 can be configured to increase the distance between base portion 484 of support member 480 and a surface 459 of printbar 441 to selectively increase a deflection of printbar 341 at that location, as previously described in association with FIG. 4.

Figure 8:
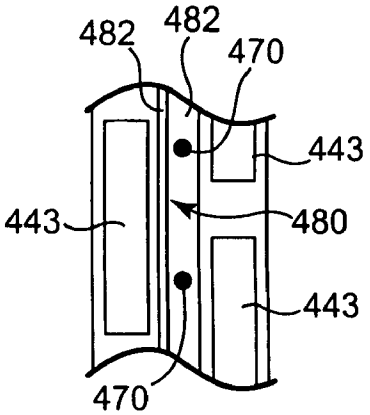
FIG. 8 is a partial top elevational view of the printbar of FIG. 5, according to an embodiment of the present disclosure.

As further illustrated in the top elevational view of FIG. 8, because the fastening mechanisms 470 are connected to a base portion 482 of support member 480, the fastening mechanisms 470 do not interfere with either first row 447A or second row 447B of cartridges slots 445 (and associated cartridges 443). Moreover, as illustrated by FIG. 7, in one aspect, fastening mechanisms 470 can be placed in locations 485 interposed between adjacent cartridge slots 443. Alternatively, fastening mechanisms 470 can be placed in other locations relative to a particular cartridge 443 to locate the desired biasing action precisely relative to each respective printhead cartridge 443. For example, as shown in FIG. 7, each cartridge includes a pair of side edges 480, 482 as well as a mid-portion 483 extending between the respective side edges 480, 482 such that fastening mechanisms 470 can be located at the mid-portion 483 or side edges 480, 482 of each cartridge 443 to achieve the desired biasing effect.

Accordingly by strategically locating fastening mechanisms 470 along the length of printbar 441 relative to the respective printhead cartridges 443, upon coupling support member 480 to printbar 441, the biasing action prevents or counteracts any deflections that otherwise would have occurred due to the length and weight of printbar 441 while being supported exclusively at its ends 455. In this manner, embodiments of a support mechanism of the present disclosure help to maintain correct spacing between each respective printhead 444 and the media M along the entire width of the media M.

In one non-limiting example, in order to determine the desired amount or degree of biasing force to counteract deflections of a printbar, the ends (such as ends 455 in FIG. 5 or 7) of a printbar are mounted between two support frames (such as support plates 246, 248 in FIG. 3) without a support member 480. Measurements are then taken of the relative spacing between each respective printhead (e.g. printhead 44 and FIGS. 1-3) in the media M to determine a deflection of the printbar 441 at a location of each of the respective printheads 44. By mapping the local deflection that occurs in each printhead 44, one can determine at which locations to mount a fastening mechanism 470 to provide a biasing action which counter acts the local deflection at that printhead 44. In one non-limiting example, the printhead-to-media spacing for an inkjet web press is preferably 1 mm+/−0.1 mm. Without the support mechanism such as support member 480, it is expected that the printbar 441 would vertically deflect up to 0.5 mm. However, with the support mechanism such as support member 480 coupled to the printbar 441, any vertical deflection of printbar 441 (due to loading and geometry of the assembly) would be limited to about 0.1 mm which would be within the acceptable range of deflection to maintain the proper printhead to media spacing.

Embodiments of the present disclosure include a support mechanism configured to lend support to a printbar of an inkjet web press to maintain the correct printhead-to-media spacing. These embodiments provide additional strength and rigidity to the printbar to relieve at least some of the stresses borne by the printbar due to loading. In addition, these embodiments include a biasing mechanism which can be deployed in one or more locations along a length of the printbar to counteract local deflections at one or more individual printheads typically located within a middle portion or intermediate portion of the printbar.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An inkjet web press comprising:

a pair of spaced apart frame supports positioned on opposite sides of a media web;

an elongate printbar extending between, and including opposite ends connected to, the respective frame supports, wherein the printbar includes a staggered array of printheads that extend across substantially an entire width of the media web with each printhead defining a printhead location along the printbar; and a support mechanism secured to the printbar and configured to apply a biasing force to locally adjust deflection of the printbar at least one of the respective printhead locations, wherein the support mechanism comprises:

an elongate rigid member free of connection to the respective frame supports; and a biasing mechanism arranged to secure the elongate rigid member to the printbar and to apply the biasing force at least one of the respective printhead locations.

2. The printer of claim 1 wherein the array of printheads includes a first row of printheads and a second row of printheads, each first and second row extending along a length of the printbar, wherein the second row is spaced apart from the first row in a direction generally transverse to the length of the printbar, and wherein the elongate rigid member extends along a length of the printbar and is interposed between the respective first and second rows of printheads.

3. The printer of claim 1 wherein the elongate rigid member has at least one of an L-shaped cross-section, an U-shaped cross-section, an I-shaped cross-section, or a T-shaped cross-section.

4. The printer of claim 1 wherein the biasing mechanism comprises an array of spring-loaded fasteners with a respective one of the fasteners positioned adjacent to each printhead location and configured to selectively apply the biasing force.

5. An inkjet web press printer comprising:

a pair of spaced apart frame supports positioned on opposite sides of a media web;

an elongate printbar extending between, and including opposite ends connected to, the respective frame supports, wherein the printbar includes a staggered array of printheads that extend across substantially an entire width of the media web with each printhead defining a printhead location along the printbar; and a support mechanism secured to the printbar and configured to apply a biasing force to locally adjust deflection of the printbar at least one of the respective printhead locations, wherein the support mechanism is configured to provide the biasing force as an array of biasing forces and at least one of the biasing forces is applied to increase the deflection at some of the respective printhead locations and at least one of the biasing forces is applied to decrease the deflection at some of the respective printhead locations.

6. The printer of claim 1 wherein the media web is advanced relative to the printbar in a first orientation with the printbar extending in a second orientation generally perpendicular to the first orientation, wherein the pair of frame supports comprises a pair of arcuate plates spaced apart from each other in the second orientation and each respective printbar extends between the respective arcuate plates of the second frame, and wherein the printbar is supported via the frame supports exclusively via opposite ends of the printbar.

7. The printer of claim 1, comprising a media support wherein the frame supports and the media support are movably relative to each other to adjust a vertical space between the frame supports and the media support.

8. An inkjet web press printer comprising:

means for supporting a printbar vertically above, and transverse to a travel direction of, a media web, the printbar including a plurality of printheads and defining a printhead location for each separate printhead; and means for applying an array of biasing forces to the printbar to adjust a deflection of the printbar locally at least one of the respective printhead locations along the printbar, wherein the means for applying a biasing force comprises:

an elongate rigid member, without connection to, the means for supporting;

and an array of fastening mechanisms arranged to secure the elongate rigid member to the printbar, wherein each respective fastening mechanism is positioned and configured to selectively apply a respective one of the biasing forces at each respective printhead location.

9. The printer of claim 8 wherein each fastening mechanism is configured to select a direction of application, and an amount of, the biasing force at each printhead location.

10. A method printing comprising:

removably securing a printbar, exclusively via opposite ends of the printbar, between a pair of frames to support an array of printheads on the printbar to extend over a media web in a direction transverse to a travel direction of the media web;

measuring a spacing between the media web and each respective printhead to identify a profile of spacing of the printheads relative to the media along a length of the printbar; and applying an array of biasing forces at separate locations along the length of the printbar to counteract the deflections of the printbar, wherein the applying the array of forces comprises:

applying the biasing force in an upward direction at one or more first locations to decrease a deflection of the printbar at the respective locations.

11. The method of claim 10, comprising:

applying the biasing force in a downward direction at one or more second locations to increase a deflection of the printbar at the respective second locations.

12. A method printing comprising:

removably securing a printbar, exclusively via opposite ends of the printbar, between a pair of frames to support an array of printheads on the printbar to extend over a media web in a direction transverse to a travel direction of the media web;

measuring a spacing between the media web and each respective printhead to identify a profile of spacing of the printheads relative to the media along a length of the printbar; and applying an array of biasing forces at separate locations along the length of the printbar to counteract the deflections of the printbar, wherein applying the array of biasing forces comprises:

fastening an elongate rigid member to the printbar via an array of fastening mechanisms secured at the respective locations; and manipulating each respective fastening mechanism to selectively apply a direction, and an amount of, the respective biasing forces.

13. The printer of claim 1, wherein the elongate rigid member is secured to a top portion of the printbar to be on an opposite side of the printbar relative to the media web.

14. The printer of claim 5, wherein the support mechanism is configured to apply at least one of the respective biasing forces in an upward direction at some of the respective printhead locations in a middle portion of the printbar and configured to apply at least one of the respective biasing forces in a downward direction at some of the respective printhead locations at opposite end portions of the printbar.

15. A method of printing comprising:

removably securing a printbar, exclusively via opposite ends of the printbar, between a pair of frames to support an array of printheads on the printbar to extend over a media web in a direction transverse to a travel direction of the media web;

measuring a spacing between the media web and each respective printhead to identify a profile of spacing of the printheads relative to the media along a length of the printbar; and applying an array of biasing forces at separate locations along the length of the printbar to counteract the deflections of the printbar, wherein the applying the array of forces comprises:

applying the biasing force in a downward direction at one or more first locations to increase a deflection of the printbar at the respective locations.

16. The method of claim 15, comprising:

applying the biasing force in an upward direction at one or more second locations to decrease a deflection of the printbar at the respective second locations.

* * * * *

UNITED STATES PATENT AND TRADEMARK OFFICE

CERTIFICATE OF CORRECTION

PATENT NO. : 8,235,484 B2
APPLICATION NO. : 12/253270
DATED : August 7, 2012
INVENTOR(S) : Paul C. Ray et al.

It is certified that error appears in the above-identified patent and that said Letters Patent is hereby corrected as shown below:

In column 11, line 2, in Claim 1, delete “press” and insert -- press printer --, therefor.

In column 11, line 13, in Claim 1, delete “at least” and insert -- at at least --, therefor.

In column 11, line 19, in Claim 1, delete “least” and insert -- at least --, therefor.

In column 11, line 47, in Claim 5, delete “at least” and insert -- at at least --, therefor.

In column 12, line 7, in Claim 8, delete “at least” and insert -- at at least --, therefor.

In column 12, line 22, in Claim 10, delete “method” and insert -- method of --, therefor.

In column 12, line 43, in Claim 12, delete “method” and insert -- method of --, therefor.

Signed and Sealed this
First Day of January, 2013

David J. Kappos

David J. Kappos
*Director of the United States Patent and Trademark Office*